US008502740B2

(12) United States Patent
Kong et al.

(10) Patent No.: US 8,502,740 B2
(45) Date of Patent: Aug. 6, 2013

(54) PORTABLE TERMINAL

(75) Inventors: Sungshin Kong, Incheon (KR); Sungkyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 503 days.

(21) Appl. No.: 12/914,770

(22) Filed: Oct. 28, 2010

(65) Prior Publication Data

US 2011/0115679 A1 May 19, 2011

(30) Foreign Application Priority Data

Nov. 17, 2009 (KR) ..... 10-2009-0111126

(51) Int. Cl.
*H01Q 1/24* (2006.01)

(52) U.S. Cl.
USPC ..... 343/702; 455/575.1

(58) Field of Classification Search
USPC ..... 343/702, 872; 455/575.1, 575.8
See application file for complete search history.

(56) References Cited

U.S. PATENT DOCUMENTS 7,058,435 B2 * 6/2006 Yamazaki ..... 455/575.8
2010/0053002 A1 * 3/2010 Wojack et al. ..... 343/702

* cited by examiner

*Primary Examiner* — Hoang V Nguyen
(74) *Attorney, Agent, or Firm* — Lee, Hong, Degerman, Kang & Waimey

(57) ABSTRACT

A portable terminal includes a first case having one or more side surfaces, and configured such that a part of the side surfaces is removed, and an antenna installed in the first case, and having a conductive radiator and a dielectric carrier for supporting the radiator, wherein the carrier includes a protrusion for filling the removed part of the first case, and the radiator is formed to be extending to the protrusion.

20 Claims, 8 Drawing Sheets

PORTABLE TERMINAL

CROSS-REFERENCE TO A RELATED APPLICATION

Pursuant to 35 U.S.C. §119(a), this application claims the benefit of earlier filing date and right of priority to Korean Application 10-2009-0111126, filed on Nov. 17, 2009, the content of which is incorporated by reference herein in its entirety.

BACKGROUND OF THE INVENTION

1. Field of the Invention

The present invention relates to a portable terminal.

2. Background of the Invention

A portable terminal is a device that can be carried around and has one or more functions such as voice and video call communication, inputting and outputting information, storing data, and the like.

As such functions become more diversified, the portable terminal can support more complicated functions such as capturing images or video, reproducing music or video files, playing games, receiving broadcast signals, and the like. By comprehensively and collectively implementing such functions, the portable terminal may be embodied in the form of a multimedia player or device.

In order to implement various functions of such multimedia players or devices, the multimedia player requires sufficient support in terms of hardware or software, for which numerous attempts are being made and implemented. For example, a user interface allowing users to easily and conveniently search for and select one or more functions is provided.

An external type antenna has firstly developed to be mounted to the portable terminal in an exposed status to the outside. However, an internal type antenna (built-in antenna) is being commercialized with consideration of the appearance of the portable terminal.

As the portable terminal becomes small and slim, it is difficult for the built-in antenna to have a length long enough to implement required communication quality. And, the built-in antenna may be easily influenced by other metallic components.

SUMMARY OF THE INVENTION

Therefore, an object of the present invention is to provide a portable terminal capable of overcoming a size limitation due to an internal type (built-in type), and capable of enhancing a wireless quality (radio characteristic).

To achieve these and other advantages and in accordance with the purpose of the present invention, as embodied and broadly described herein, there is provided a portable terminal, comprising: a first case having one or more side surfaces, and configured such that a part of the side surfaces is removed; and an antenna installed in the first case, and having a conductive radiator and a dielectric carrier for supporting the radiator, wherein the carrier includes a protrusion for filling the removed part of the first case, and the radiator is formed to be extending to the protrusion.

A through hole may be formed at the protrusion of the carrier.

An insertion protrusion inserted into the through hole may be formed at the case.

The through hole may be formed in plurality in number, and the through hole may be partitioned from each other by a partition wall formed at the carrier.

A partition wall accommodation recess configured to accommodate the partition wall therein may be formed at the case.

The portable terminal may further comprise a second case coupled to the first case, and the second case may include one or more hooks for coupling with the first case. A hook passing hole configured to pass the hook therethrough may be formed at one side of the insertion protrusion.

The portable terminal may further comprise a side cover attached to a side surface of the first case and configured to cover the side surface of the first case.

A surface of the protrusion of the carrier may be formed so as not to be protruding more than the side surface of the first case.

The side surface of the first case may be recessed from an edge which encompasses the side surface by a predetermined depth.

According to another aspect of the present invention, there is provided a portable terminal, comprising: a first case having one or more side surfaces, and configured such that a part of the side surfaces is removed; and an antenna installed in the first case, and having a conductive radiator and a dielectric carrier for supporting the radiator, wherein the radiator includes a first radiator formed on a first mounting surface disposed at an inner side of the first case, and a second radiator formed on a second mounting surface exposed to outside through the removed part of the first case.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

The portable terminal according to exemplary embodiments of the present invention will now be described with reference to the accompanying drawings. In the following description, usage of suffixes such as 'module', 'part' or 'unit' used for referring to elements is given merely to facilitate explanation of the present invention, without having any significant meaning by itself. The portable terminal may include a portable phone, a smart phone, a notebook computer, a digital broadcasting terminal, Personal Digital Assistants (PDA), Portable Multimedia Player (PMP), a navigation system, etc.

Figure 1:
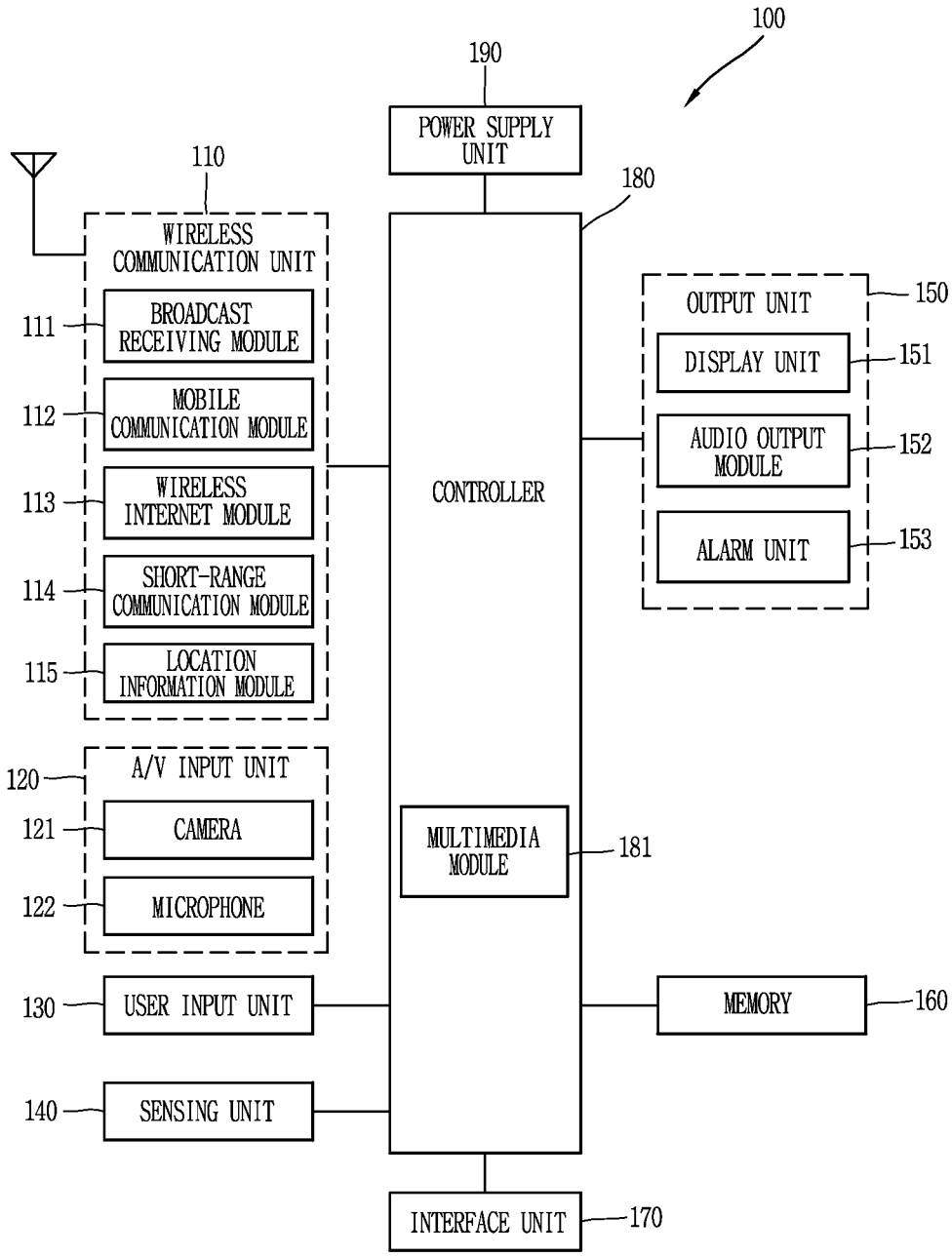
FIG. 1 is a block diagram of a portable terminal according to one embodiment of the present invention.

FIG. 1 is a block diagram of a portable terminal in accordance with one exemplary embodiment of the present invention.

The portable terminal 100 may comprise components, such as a wireless communication unit 110, an Audio/Video (A/V) input unit 120, a user input unit 130, a sensing unit 140, an output unit 150, a memory 160, an interface unit 170, a controller 180, a power supply unit 190 and the like.

FIG. 1 shows the portable terminal 100 having various components, but it is understood that implementing all of the illustrated components is not a requirement. Greater or fewer components may alternatively be implemented.

Hereinafter, each component is described in sequence.

The wireless communication unit 110 may typically include one or more modules which permit wireless communications between the portable terminal 100 and a wireless communication system or between the portable terminal 100 and a network within which the portable terminal 100 is located. For example, the wireless communication unit 110 may include a broadcast receiving module 111, a mobile communication module 112, a wireless internet module 113, a short-range communication module 114, a position location module 115 and the like.

The broadcast receiving module 111 receives a broadcast signal and/or broadcast associated information from an external broadcast managing entity via a broadcast channel. The broadcast channel may include a satellite channel and a terrestrial channel. The broadcast managing entity may indicate a server which generates and transmits a broadcast signal and/or broadcast associated information or a server which receives a pre-generated broadcast signal and/or broadcast associated information and sends them to the portable terminal. The broadcast signal may be implemented as a TV broadcast signal, a radio broadcast signal, and a data broadcast signal, among others. The broadcast signal may further include a data broadcast signal combined with a TV or radio broadcast signal. Examples of broadcast associated information may include information associated with a broadcast channel, a broadcast program, a broadcast service provider, and the like. The broadcast associated information may be provided via a mobile communication network, and received by the mobile communication module 112.

The broadcast associated information may be implemented in various formats. For instance, broadcast associated information may include Electronic Program Guide (EPG) of Digital Multimedia Broadcasting (DMB), Electronic Service Guide (ESG) of Digital Video Broadcast-Handheld (DVB-H), and the like. The broadcast receiving module 111 may be configured to receive digital broadcast signals transmitted from various types of broadcast systems. Such broadcast systems may include Digital Multimedia Broadcasting-Terrestrial (DMB-T), Digital Multimedia Broadcasting-Satellite (DMB-S), Media Forward Link Only (MediaFLO), Digital Video Broadcast-Handheld (DVB-H), Integrated Services Digital Broadcast-Terrestrial (ISDB-T) and the like. The broadcast receiving module 111 may be configured to be suitable for every broadcast system transmitting broadcast signals as well as the digital broadcasting systems.

Broadcast signals and/or broadcast associated information received via the broadcast receiving module 111 may be stored in a suitable device, such as a memory 160.

The mobile communication module 112 transmits and receives radio signals to and from at least one of a base station, an external terminal and a server. Such radio signals may include a voice call signal, a video call signal or various types of data according to text/multimedia message transmission and reception.

The wireless Internet module 113 refers to a module for a wireless Internet access. This module may be internally or externally coupled to the terminal. The wireless Internet technique may include a WLAN (Wireless LAN) (Wi-Fi), Wibro (Wireless broadband), Wimax (World Interoperability for Microwave Access), HSDPA (High Speed Downlink Packet Access), etc.

The short-range communication module 114 refers to a module for short-range communication. As the short range communication technologies, Bluetooth™, radio frequency identification (RFID), infrared data association (IrDA), ultra-wideband (UWB), ZigBee™, etc., may be used.

The location information module 115 is a module for checking or acquiring a location (or position) of the portable terminal. A typical example of the location information module is a GPS (Global Positioning System). According to the current technology, the GPS module 115 calculates distance information from three or more satellites and accurate time information and applies trigonometry to the calculated information to thereby accurately calculate three-dimensional current location information according to latitude, longitude, and altitude. Currently, a method for calculating location and time information by using three satellites and correcting an error of the calculated location and time information by using another one satellite. In addition, the GPS module 115 can calculate speed information by continuously calculating the current location in real time.

The A/V input unit 120 is configured to receive an audio or video signal. The A/V input unit 120 may include a camera 121 and a microphone 122. The camera 121 processes image data of still pictures or video obtained by an image capture device in a video capturing mode or an image capturing mode. The processed image frames may be displayed on a display unit 151 (or other visual output device).

The image frames processed by the camera 121 may be stored in the memory unit 160 or transmitted via the wireless communication unit 110. Two or more cameras 121 may be provided according to the configuration of the portable terminal.

The microphone 122 may receive sounds (audible data) via a microphone or the like in a phone call mode, a recording mode, a voice recognition mode, and the like, and can process such sounds into audio data. The processed audio (voice) data may be converted for output into a format transmittable to a mobile communication base station via the mobile communication module 112 in case of the phone call mode. The microphone 122 may implement various types of noise canceling (or suppression) algorithms to cancel (or suppress) noise or interference generated in the course of receiving and transmitting audio signals.

The user input unit 130 (or other user input device) may generate key input data from commands entered by a user to control various operations of the portable terminal. The user input unit 130 allows the user to enter various types of information, and may include a keypad, a dome switch, a touch pad (e.g., a touch sensitive member that detects changes in resistance, pressure, capacitance, etc. due to being contacted) a jog wheel, a jog switch, and the like. In particular, when the touch pad is overlaid on the display unit 151 in a layered manner, it may form a touch screen.

The sensing unit 140 detects a current status (or state) of the portable terminal 100 such as an opened or closed state of the portable terminal 100, a location of the portable terminal 100, the presence or absence of user contact with the portable terminal 100 (i.e., touch inputs), the orientation of the portable terminal 100, an acceleration or deceleration movement and direction of the portable terminal 100, etc., and generates commands or signals for controlling the operation of the portable terminal 100. For example, when the portable terminal 100 is implemented as a slide type mobile phone, the sensing unit 140 may sense whether the slide phone is opened or closed. In addition, the sensing unit 140 can detect whether or not the power supply unit 190 supplies power or whether or not the interface unit 170 is coupled with an external device. Meanwhile, the sensing unit 140 may include a proximity sensor. The proximity sensor will be described in relation to a touch screen later.

The interface unit 170 serves as an interface by which at least one external device may be connected with the portable terminal 100. For example, the external devices may include wired or wireless headset ports, an external power supply ports, wired or wireless data ports, memory card ports, ports for connecting a device having an identification module, audio input/output (I/O) ports, video I/O ports, earphone ports, or the like.

The identification module may be a chip that stores various information for authenticating user's authority for using the portable terminal 100 and may include a user identity module (UIM), a subscriber identity module (SIM) a universal subscriber identity module (USIM), and the like. In addition, the device having the identification module (referred to as the 'identifying device', hereinafter) may take the form of a smart card. Accordingly, the identifying device may be connected with the terminal 100 via a port or other connection means. The interface unit 170 may be used to receive inputs (e.g., data, information, power, etc.) from an external device and transfer the received inputs to one or more elements within the portable terminal 100 or may be used to transfer data between the portable terminal and an external device.

In addition, when the portable terminal 100 is connected with an external cradle, the interface unit 170 may serve as a conduit to allow power from the cradle to be supplied therethrough to the portable terminal 100 or may serve as a conduit to allow various command signals inputted from the cradle to be transferred to the portable terminal therethrough. Various command signals or power inputted from the cradle may operate as a signal for recognizing that the portable terminal is accurately mounted on the cradle.

The output unit 150 is configured to provide outputs in a visual, audible, and/or tactile manner (e.g., audio signal, video signal, alarm signal, vibration signal, etc.). The output unit 150 may include the display unit 151, an audio output module 152, an alarm unit 153, and the like.

The display unit 151 may display information processed in the portable terminal 100. For example, when the portable terminal 100 is in a phone call mode, the display unit 151 may display a User Interface (UI) or a Graphic User Interface (GUI) associated with a call or other communication (such as text messaging, multimedia file downloading, etc.). When the portable terminal 100 is in a video call mode or image capturing mode, the display unit 151 may display a captured image and/or received image, a UI or GUI that shows videos or images and functions related thereto, and the like.

Meanwhile, when the display unit 151 and the touch pad are overlaid in a layered manner to form a touch screen, the display unit 151 may function as both an input device and an output device. The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like.

The proximity sensor may be disposed within or near the touch screen. The proximity sensor is a sensor for detecting the presence or absence of an object relative to a certain detection surface or an object that exists nearby by using the force of electromagnetism or infrared rays without a physical contact. Without the proximity sensor, if the touch screen is an electrostatic type, the approach of a pointer (stylus) can be detected based on a change in a field according to the approach of the pointer.

The audio output module 152 may convert and output as sound audio data received from the wireless communication unit 110 or stored in the memory unit 160 in a call signal reception mode, a call mode, a record mode, a voice recognition mode, a broadcast reception mode, and the like. Also, the audio output module 152 may provide audible outputs related to a particular function performed by the portable terminal 100 (e.g., a call signal reception sound, a message reception sound, etc.). The audio output module 152 may include a speaker, a buzzer, or other sound generating device.

The alarm unit 153 (or other type of user notification means) may provide outputs to inform about the occurrence of an event of the portable terminal 100. Typical events may include call reception, message reception, key signal inputs, a touch input etc. In addition to audio or video outputs, the alarm unit 153 may provide outputs in a different manner to inform about the occurrence of an event. For example, the alarm unit 153 may provide an output in the form of vibrations (or other tactile or sensible outputs). When a call, a message, or some other incoming communication is received, the alarm unit 153 may provide tactile outputs (i.e., vibrations) to inform the user thereof. By providing such tactile outputs, the user can recognize the occurrence of various events even if his mobile phone is in the user's pocket. Outputs informing about the occurrence of an event may be also provided via the display unit 151 or the audio output module 152.

The memory unit 160 may store software programs or the like used for the processing and controlling operations performed by the controller 180, or may temporarily store data (e.g., a phonebook, messages, still images, video, etc.) that have been outputted or which are to be outputted. In addition, the memory unit 160 may store data regarding various patterns of vibrations and sounds outputted when a touch is applied onto the touch screen.

The memory unit 160 may include at least one type of storage medium including a Flash memory, a hard disk, a multimedia card, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only Memory (PROM), a magnetic memory, a magnetic disk, an optical disk, and the like. Also, the portable terminal 100 may operate a web storage that performs the storage function of the memory unit 160 over a network connection.

The controller 180 typically controls the general operations of the portable terminal. For example, the controller 180 performs controlling and processing associated with voice calls, data communications, video calls, and the like. In addition, the controller 180 may include a multimedia module 181 for reproducing (or playing back) multimedia data. The multimedia module 181 may be configured within the controller 180 or may be configured to be separate from the controller 180.

The controller 180 may perform a pattern recognition processing to recognize a handwriting input or a picture drawing input performed on the touch screen as characters or images.

The power supply unit 190 receives external power (via a power cable connection) or internal power (via a battery of the portable terminal) and supplies appropriate power required for operating respective elements and components under the control of the controller 180.

Figure 2:
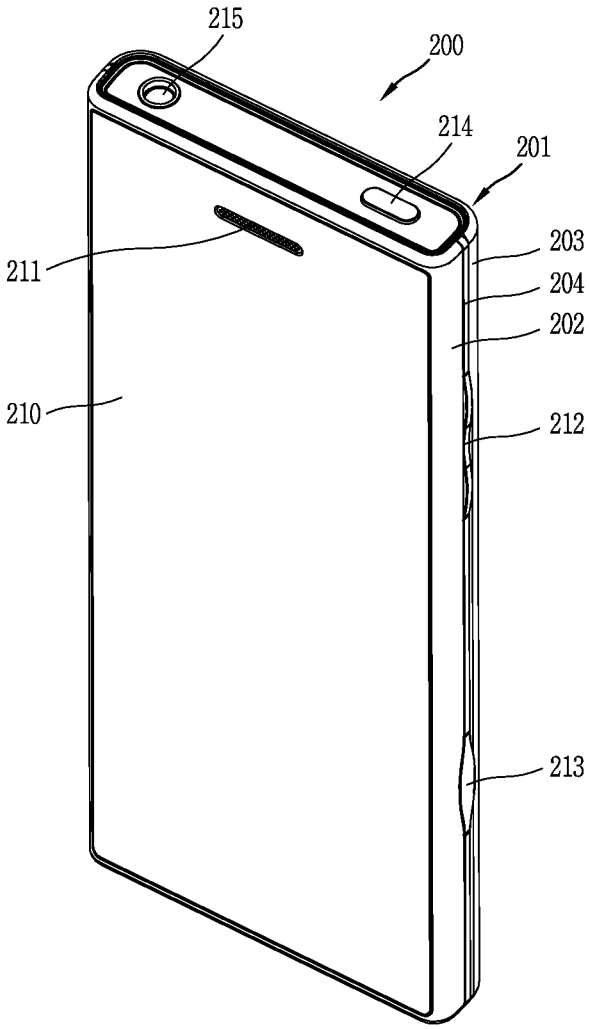
FIG. 2 is a front perspective view of the portable terminal according to the present invention.
Figure 3:
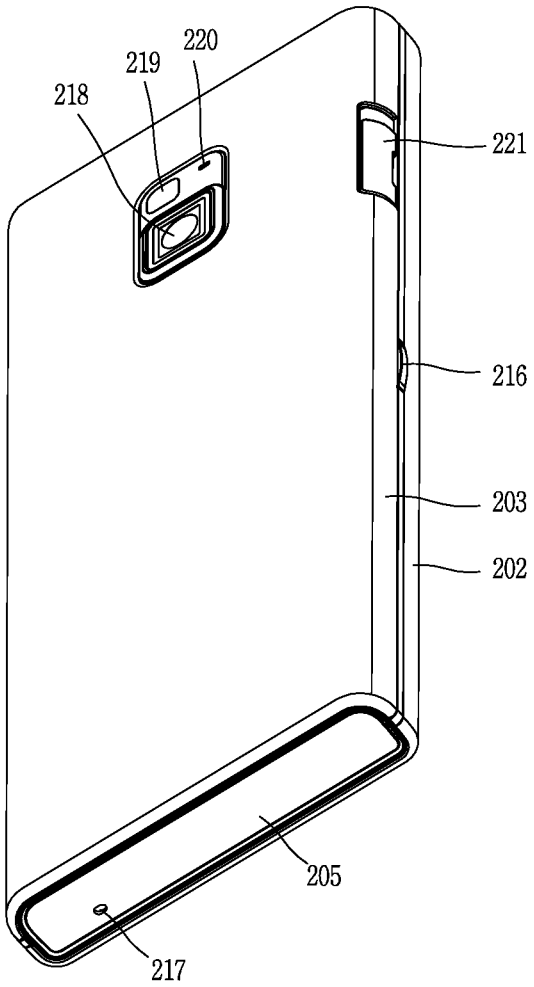
FIG. 3 is a rear perspective view of the portable terminal of FIG. 2.

FIG. 2 is a front perspective view of the portable terminal in accordance with the one embodiment of the present invention, and FIG. 3 is a rear perspective view of the portable terminal of FIG. 2.

The portable terminal 200 described is provided with a bar type of terminal body 201. However, the present invention is not limited to this type, but applicable to various configurations, such as a slide type that two or more bodies are coupled to each other so as to be relatively moved, a folder type, a swing type, a swivel type and the like.

The terminal body 201 includes a case (casing, housing, cover, etc.) which forms an outer appearance. The case may be classified into a front case 202 and a rear case 203. A space formed by the front case 202 and the rear case 203 may accommodate various components therein. At least one intermediate case 204 may further be disposed between the front case 202 and the rear case 203.

Such cases may be formed by injection-molded synthetic resin, or may be formed using a metallic material such as stainless steel (STS) or titanium (Ti). Alternatively, the cases may be formed by mixing a metallic material with synthetic resin.

A display unit 210, an audio output unit 211, etc. may be disposed on a front surface of the terminal body 201.

The display unit 210 may be implemented as a liquid crystal display (LCD) module for visually displaying information, an organic light emitting diode (OLED) module, an e-paper, and the like. The display unit 210 may include a touch sensing unit allowing for an inputting operation in a touch manner. Thus, when a point on the display unit 210 is touched, content corresponding to the touched position is inputted. The content inputted in the tactile manner may be characters, numbers, menu items that can be indicated or designated in various modes, and the like.

The audio output unit 211 may be implemented in the form of a receiver that transfers a speaker sound to the user's ear, or in the form of a loud speaker for outputting various alarm sounds or a multimedia reproduction sound.

Side keys 212, 213 and 216, an interface unit 221, etc. are arranged on side surfaces of the terminal body 201.

The side keys 212, 213 and 216 may be referred to as a manipulation unit, and are configured to receive commands for controlling the operation of the portable terminal 200. Contents inputted by the side keys 212, 213 and 216 may be variously set. For instance, through the side keys 212, 213 and 216, the image input unit 218 may be controlled, a level of sound outputted from the audio output unit 211 may be controlled, or the current mode of the display unit 210 may be converted into a touch recognition mode. Referring to FIGS. 2 and 3, the side keys include a first side key 212 for controlling a volume, etc., a second side key 213 for manipulating a camera, and a third side key 216 for executing other functions.

Referring to FIG. 3, the portable terminal 200 includes a side cover 205 separately provided from the front case 202 or the rear case 203. The side cover 205 may be mounted to a side surface of an upper end of the portable terminal 200. A sound hole 217 for guiding sound to an audio input unit 228 (refer to FIG. 5) is formed at the side cover 205. The audio input unit 228 may be implemented as a microphone, for example, so as to receive a user's voice, other sound, etc.

An interface unit 221 may be arranged on one side surface of the terminal body 201. The interface unit 221 may serve as a passage through which the portable terminal 200 of the present invention exchanges data with external devices. For instance, the external devices include wired/wireless terminals to be connected to earphones, power supplies to supply power to short-range communication ports (e.g., IrDA port, Bluetooth port, and wireless LAN port). Also, the interface unit 221 may be implemented as a card socket (e.g., for coupling to a memory card, subscriber identity module (SIM) card, and user identity module (UIM) card). The interface unit 221 may include a cap for covering when not used. Referring to FIG. 2, a jack 215 for plugging an ear set therein as a type of the interface unit 221, and an infrared ray port 214 for infrared-ray communications are formed on side surfaces of an upper end of the terminal body 201.

An image input unit 218 may be disposed on a front surface or a rear surface of the terminal body 201. Referring to FIG. 3, the image input unit 218 is disposed on the rear surface of the terminal body 201. The image input unit disposed on the front surface of the terminal body 201 may be used to capture a user's face in case of a video call, etc.

A flash 220 and a mirror 219 are arranged near the image input unit (camera) 218. When capturing an object by the image input unit 218, the flash 220 provides light toward the object. The mirror 219 is useful for assisting a user to position the image input unit 218 in a self-portrait mode.

Figure 4:
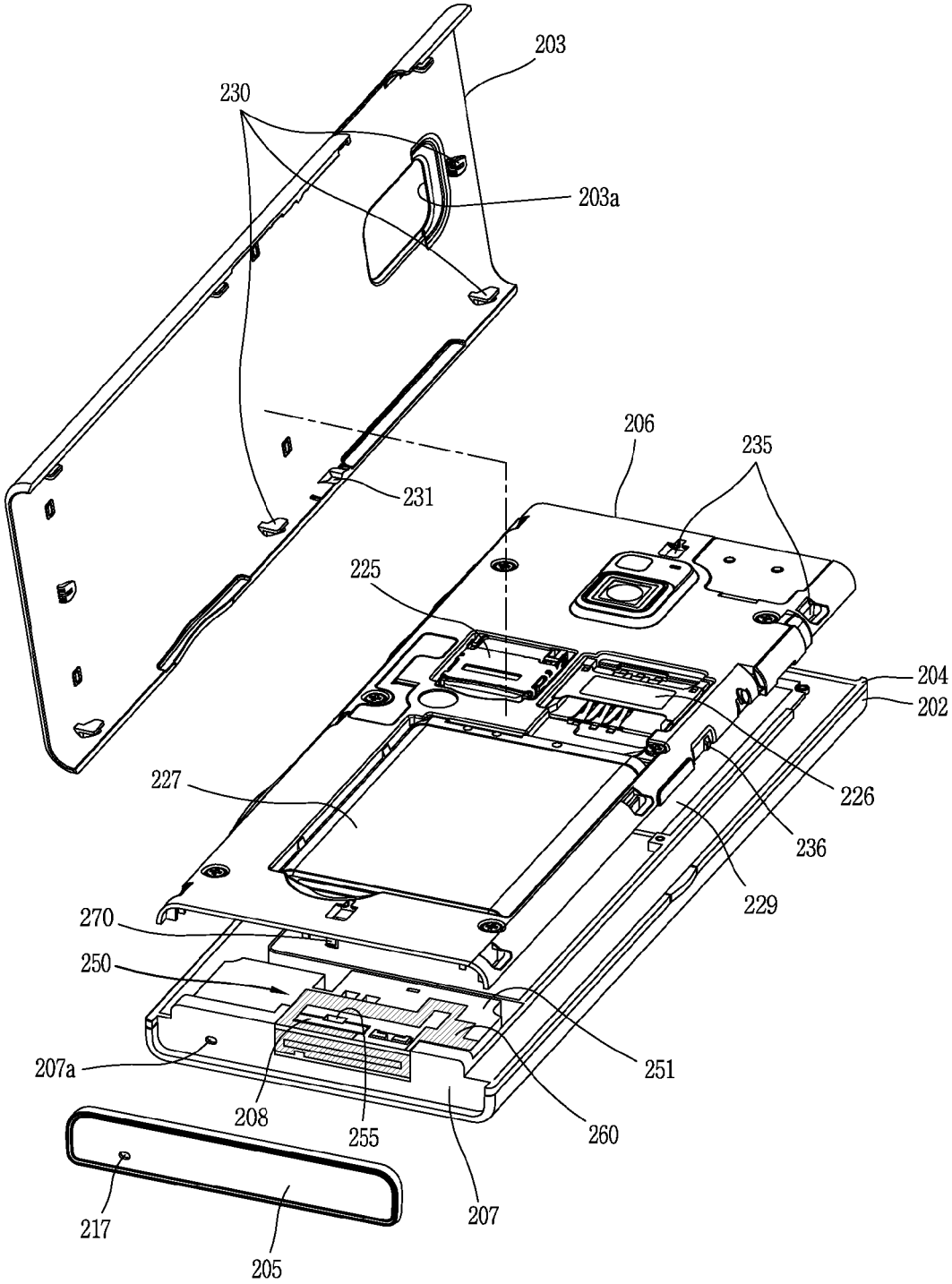
FIG. 4 is a rear assembled perspective view of the portable terminal according to the present invention.

A battery 227 for supplying power to the portable terminal 200 is mounted to a rear surface of the terminal body 201. The battery 227 may be mounted in the terminal body 201, or may be detachably mounted to the terminal body 201. Referring to FIG. 4, the battery 227 is disposed in the rear case 203.

FIG. 4 is a rear assembled perspective view of the portable terminal according to the present invention.

As shown in FIG. 4, the terminal body 201 may be implemented by a front case 202, a rear case 203, and a middle case 206 assembled to one another.

The rear case 203 is a cover open and closed so as to exchange the battery 227 with a new one, or to exchange a memory card or a UIM/SIM card installed in the rear case 203.

The rear case 203 may include a locking means 230 configured to lock or release the rear case 203 with respect to the middle case 206. The locking means 230 may have a structure including protrusions protruded with an inclination angle and recess, and may have a horizontal stopper 231 for preventing backward motion of the rear case 203 engaged with the middle case 206. Recesses 235 and a locking protrusion 236 may be formed at the middle case 206 in correspondence to the locking means 230 and the horizontal stopper 231.

The middle case 206 is provided with a battery mounting portion for mounting the battery 227, and a memory card socket 225 or a UIM/SIM card socket 226, etc. are installed at one side of the battery 227.

The display unit 210 may be installed on a front surface of the front case 202, and a rear surface of the front case 202 forms a space for mounting a circuit board 229 and the battery 227.

The front case 202 includes a side surface 207 which forms a side surface of the terminal body 201. Referring to FIG. 4, the side surface 207 is recessed from an edge of the front case 202 by a predetermined depth, and an antenna 250 is installed in the side surface 207.

The antenna 250 includes a conductive radiator 260 and a dielectric carrier 251 for supporting the radiator 260. The carrier 251 may be formed by injection-molding plastic having a high dielectric constant. And, the radiator 260 may be configured to have a pattern which satisfies a radio bandwidth of the antenna.

The carrier 251 of the antenna 250, and a side structure of the front case 202 will be explained in more detail with reference to FIGS. 5 and 6.

Figure 5:
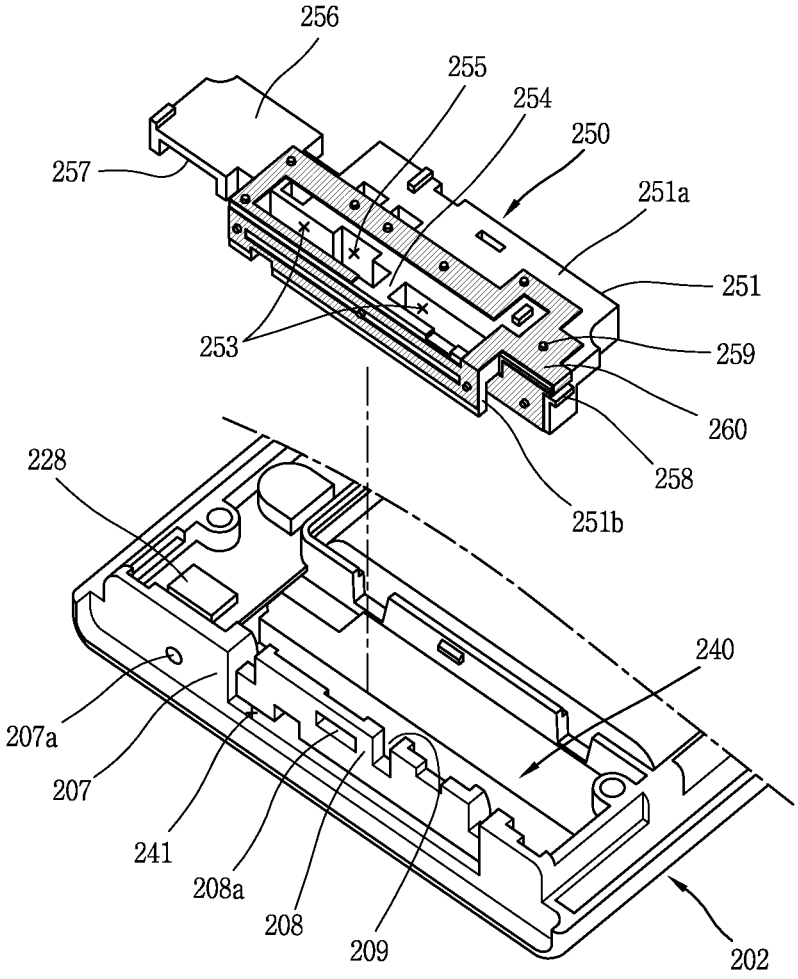
FIG. 5 is a disassembled perspective view of a front case and an antenna.

FIG. 5 is a disassembled perspective view of the front case and the antenna.

The radiator 260 of the antenna 250 may be implemented in the form of thin conductive metal so as to be easily formed on the surface of the carrier 251.

For stable fixing, fixing protrusions 259 inserted into insertion holes of the radiator 260 are formed on the surface of the carrier 251.

An antenna mounting portion 240 for mounting the antenna 250 is formed in the side surface 207 of the front case 202. The antenna mounting portion 240 may be implemented by a rib protruding from an inner surface of the front case 202 so as to prevent movement or position changes of the antenna 250.

Referring to FIG. 5, the side surface 207 of the case 202 includes a removed part 241, a region implemented as a part of the side surface 207 has been removed. Due to the removed part 241, all the side surfaces of the case 202 are not formed. However, the removed part 241 serves to accommodate therein a part of the antenna 250.

The carrier 251 of the antenna 250 includes a first portion 251*a* disposed in the side surface 207, and a second portion 251*b* protruding from the removed part 241. The radiator 260 is formed to be extending up to the second portion 251*b* of the carrier 251.

The second portion 251*b* is formed to have a width and a height corresponding to those of the removed part 241. The second portion 251*b* is inserted into the removed part 241.

A microphone 228 may be disposed at one side of the antenna 250, and a microphone hole 207*a* is formed on the side surface 207 of the front case 202 so that sound outside the portable terminal 200 can be transmitted to the microphone 228 disposed in the side surface 207. The carrier 251 may include an extended portion 256 having an accommodation recess 257 for accommodating therein the microphone 228.

A plurality of hook members 258 for fixing the antenna 250 to the front case 202 are formed on a side surface of the carrier 251. These hook members 258 serve to temporarily fix the antenna 250 to the front case 202 before the middle case 206 is coupled to the front case 202 for assembly of the portable terminal 200.

The second portion 251*b* is formed by the removed part 241 of the side surface 207 of the front case 202, and has the following advantages.

Firstly, a space occupied by the antenna 250 is increased by a protruded length of the second portion 251*b*. This increased space does not cause reduction of spaces occupied by other components of the portable terminal 200.

The second portion 251*b* is extending toward an outer side of the portable terminal 200, thereby being scarcely electromagnetically influenced by other components inside the portable terminal 200. This may allow the antenna 250 to have an enhanced performance.

The following table 1 shows a performance of the antenna 250, in which performances of antennas each designed to operate in a plurality of bands are compared with one another.

TABLE 1

| | Divisions (Bands) | | | | |
|---|---|---|---|---|---|
| | GSM850 | GSM900 | DCS | PCS | CDMA |
| Target value (dBm) | 28.0 | 28.0 | 25.0 | 25.0 | 18.5 |
| Conventional side surface which has not been partially removed (dBm) | 27.7 | 27.2 | 23.3 | 26.5 | 18.4 |
| Side surface which has been partially removed according to the present invention (dBm) | 29.8 | 28.6 | 27.1 | 28.2 | 20.4 |

As shown in the table 1, in a case that an antenna is arranged in a completely closed side surface (i.e., side surface which has not been partially removed) in accordance with the conventional art, the antenna had a radio characteristic less than a target value (reference value) in some bands (GSM850, GSM900, CCS, WCDMA) among the illustrated bands. However, in a case that the second portion 251*b* of the carrier 251 is extending to the removed part 241, the antenna had a radio characteristic more than a target value (reference value) in all of the illustrated bands.

Furthermore, the antenna structure having a removed part according to the present invention has an advantage to reduce performance changes of the antenna by a human body, especially, a user's hand (hand effect).

The second portion 251*b* of the carrier 251 stably fixes the carrier 251 to the front case 202, and reinforces a lowered strength of the front case 202 due to the removed part 241, thereby providing a stable structure.

Referring to FIG. 5 back, a through hole 253 is formed at the second portion 251*b* of the carrier 251, and an insertion protrusion 208 to be inserted into the through hole 253 is formed at the front case 202. The through hole 253 of the carrier 251, and the insertion protrusion 208 of the case 202 reinforces a lowered strength of the front case 202 due to the removed part 241, and enhances supporting force of the carrier 251. The insertion protrusion 208 of the front case 202 constitutes a part of the carrier 251 of the antenna 250. Under this configuration, the front case 202 constitutes a part of the antenna 250. This may allow an inner space of the portable terminal to be obtained by an area shifted by the antenna 250.

Referring to FIG. 5, the through hole 253 is formed in plurality in number, and the plurality of through holes 253 are separated from each other by a partition wall 254 of the carrier 251. The partition wall 254 and the through holes 253 enhance strength of the second portion 251*b* of the carrier 251. A partition wall accommodation recess 209 configured to accommodate the partition wall 254 therein may be formed at the front case 202.

A passing hole 255 is formed at one side of the through hole 253. As shown in FIG. 4, the passing hole 255 serves to pass a hook 270 formed at the middle case 206 therethrough, and smoothly fixes the hook 270 of the middle case 206 to the front case 202 when the front case 202 and the middle case 206 are assembled to each other. As shown in FIG. 5, a hook passing hole 208*a* configured to pass the hook 207 therethrough may be formed at one side of the insertion protrusion 208.

Once the middle case 206 and the front case 202 are assembled to each other, a side cover 205 is attached to the side surface of the rear case so as to prevent the antenna 250 from being exposed to outside. This side cover 205 may also serve as a decoration member. In this case, the surface of the second portion 251*b* of the carrier 251 is preferably formed so as not to be protruding more than the surface of the side surface 207 of the front case 202.

Figure 6:
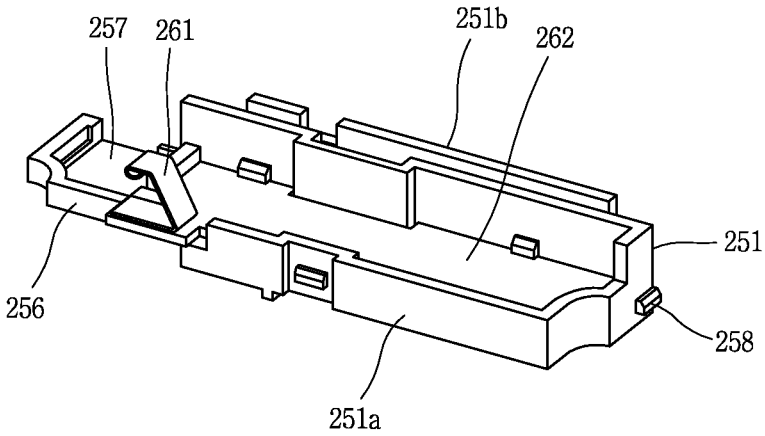
FIG. 6 is a rear perspective view of an antenna according to the present invention.

FIG. 6 is a rear perspective view of the antenna according to the present invention.

As shown in FIG. 6, a circuit board 262 may be arranged on an inner side surface of the carrier 251 separately from the carrier 251. This circuit board 262 may include some of radiators for covering a plurality of bands, or may include elements for matching.

A ground feeding portion 261 for connecting the radiator 260 to a ground inside the portable terminal is provided on the surface of the circuit board 262. The ground feeding portion 261 may be implemented in the form of a conductive elastic spring, e.g., a 'c-clip' shown in FIG. 6.

Figure 7:
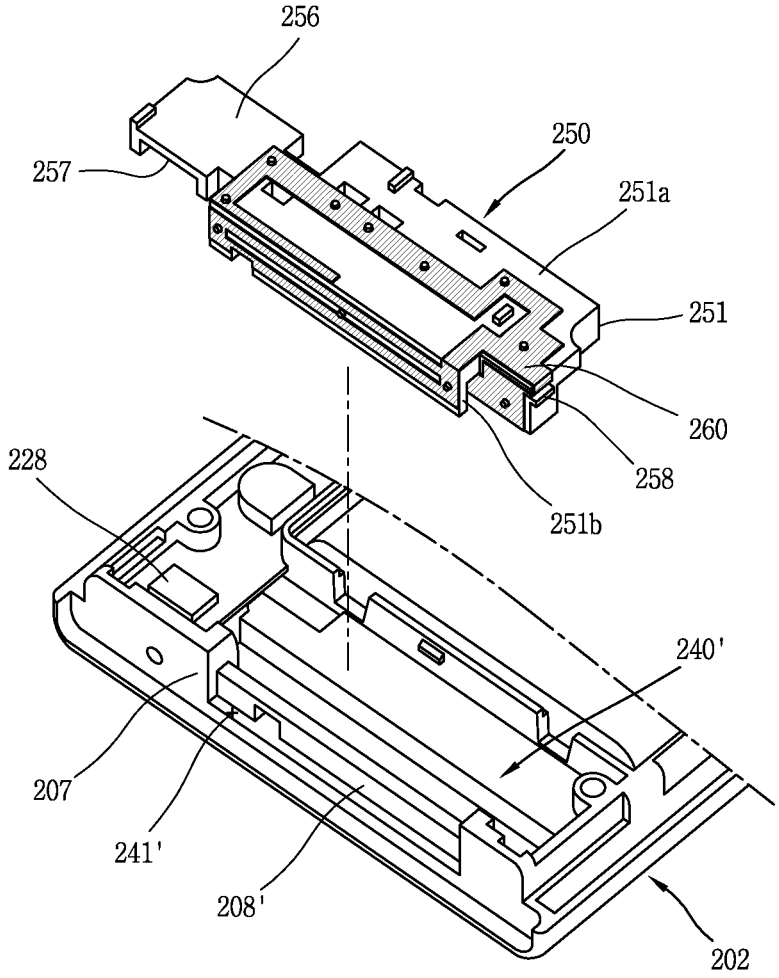
FIG. 7 is a disassembled perspective view of an antenna and a case according to another embodiment of the present invention.
Figure 8:
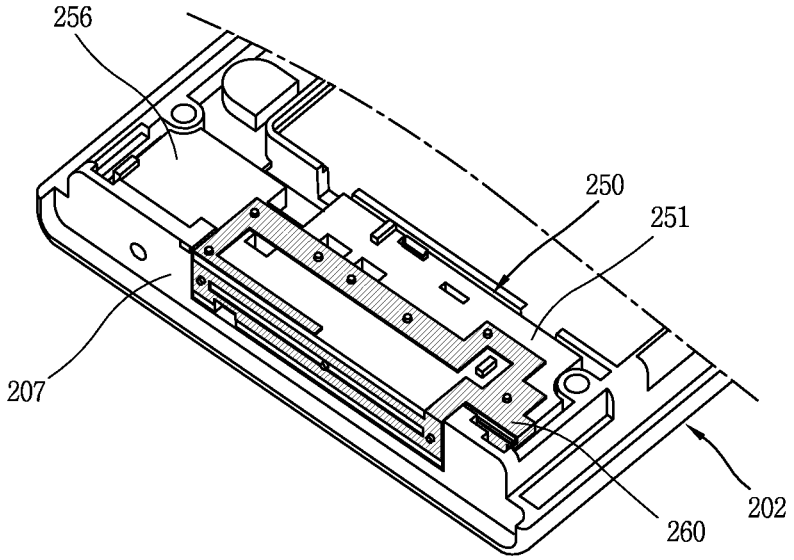
FIG. 8 is an assembled perspective view of the antenna and the case of FIG. 7.

FIG. 7 is a disassembled perspective view of an antenna and a case according to another embodiment of the present invention, and FIG. 8 is an assembled perspective view of the antenna and the case of FIG. 7.

Referring to FIGS. 7 and 8, the carrier 251 of the antenna 250 includes a first portion 251*a* and a protruded second portion 251*b*. The protruded second portion 251*b* is formed to be mounted to a removed part 241' of the front case 202. An insertion protrusion 208' formed at one side of the removed part 241' is formed to be locked by a recess formed at the second portion 251*b* of the carrier 251.

According to the portable terminal of the present invention, the removed part is formed at a part of the case, and the antenna is protruding from the removed part. This may increase capacity of the antenna without increasing a size of the portable terminal, thereby greatly enhancing a radio performance of the built-in type antenna.

Furthermore, the removed part of the case is filled by the carrier of the antenna, thereby reinforcing a part of the case having a weak mechanical strength. Besides, since the removed part of the case is formed so as to accommodate therein the protrusion of the carrier of the antenna, the portable terminal can be applied to a high frequency antenna (e.g., GPS, BLUETOOTH™, WiFi antenna, etc.).

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal, comprising:

a first case comprising one or more side surfaces with a portion of the one or more side surfaces removed; and an antenna installed in the first case, the antenna having a conductive radiator and a dielectric carrier configured to support the conductive radiator, wherein the dielectric carrier comprises a protrusion that is accommodated within the removed portion of the one or more side surfaces, and wherein the conductive radiator extends to the protrusion.

2. The portable terminal of claim 1, wherein the protrusion of the dielectric carrier comprises at least one through hole formed therein.

3. The portable terminal of claim 2, wherein the first case further comprises an insertion protrusion configured to be inserted into the at least one through hole.

4. The portable terminal of claim 2, wherein:

the protrusion of the dielectric carrier comprises a plurality of through holes formed therein; and the dielectric carrier further comprises a partition wall configured to partition the plurality of through holes from each other.

5. The portable terminal of claim 4, wherein the first case further comprises a partition wall accommodation recess configured to accommodate the partition wall therein.

6. The portable terminal of claim 2, further comprising a second case having one or more hooks configured to couple the second case to the first case and wherein the protrusion of the dielectric carrier further comprises a hook passing hole formed at one side of insertion protrusion and configured to receive the one or more hooks.

7. The portable terminal of claim 1, wherein the first case further comprises a side surface and a side cover attached to the first case such that the side cover covers the side surface.

8. The portable terminal of claim 7, wherein a surface of the protrusion of the dielectric carrier is formed such that it does not protrude past the side surface of the first case.

9. The portable terminal of claim 7, wherein the side surface of the first case is formed such that it is recessed by a predetermined depth from an edge that encompasses the side surface.

10. The portable terminal of claim 1, wherein the protrusion of the dielectric carrier protrudes from the removed portion of the one or more side surfaces.

11. The portable terminal of claim 1, wherein the protrusion of the dielectric carrier has a width and height corresponding to a width and height of the removed portion of the one or more side surfaces.

12. A portable terminal, comprising:

a first case comprising one or more side surfaces with a portion of the one or more side surfaces removed;

a first mounting surface located at an inner side of the first case; and an antenna installed in the first case, the antenna having a conductive radiator and a dielectric carrier configured to support the conductive radiator, wherein the conductive radiator includes a first radiator formed on the first mounting surface and a second radiator formed on a second mounting surface that is exposed externally from the mobile terminal through the removed portion of the one or more side surfaces.

13. The portable terminal of claim 12, wherein the dielectric carrier comprises a protrusion that is accommodated within the removed portion of the one or more side surfaces.

14. The portable terminal of claim 13, wherein the protrusion of the dielectric carrier comprises at least one through hole formed therein.

15. The portable terminal of claim 14, wherein the first case further comprises an insertion protrusion configured to be inserted into the at least one through hole.

16. The portable terminal of claim 14, further comprising a second case having one or more hooks configured to couple the second case to the first case and wherein the protrusion of the dielectric carrier further comprises a hook passing hole formed at one side of the at least one through hole and configured to receive the one or more hooks.

17. The portable terminal of claim 13, wherein the first case further comprises a side surface and a side cover attached to the first case such that the side cover covers the side surface.

18. The portable terminal of claim 17, wherein a surface of the protrusion of the dielectric carrier is formed such that it does not protrude past the side surface of the first case.

19. The portable terminal of claim 17, wherein the side surface of the first case is formed such that it is recessed by a predetermined depth from an edge that encompasses the side surface.

20. The portable terminal of claim 13, wherein the protrusion of the dielectric carrier protrudes from the removed portion of the one or more side surfaces.

* * * * *